US006655955B2

(12) United States Patent
Wachter et al.

(10) Patent No.: US 6,655,955 B2
(45) Date of Patent: Dec. 2, 2003

(54) COOLABLE ARCHED ROOF

(75) Inventors: Erwin Wachter, Zürich (CH); Klaus Zoss, Uster (CH); Bruno Andreoli, Uerikon (CH); Werner Seglias, Uerikon (CH)

(73) Assignee: Von Roll Umwelttechnik AG, Zürich (CH)

( * ) Notice: Subject to any disclaimer, the term of this patent is extended or adjusted under 35 U.S.C. 154(b) by 0 days.

(21) Appl. No.: 10/334,657

(22) Filed: Dec. 31, 2002

(65) Prior Publication Data

US 2003/0175647 A1 Sep. 18, 2003

(30) Foreign Application Priority Data

Dec. 31, 2001 (CH) ..... 2001 2384/01

(51) Int. Cl.[7] ..... F27D 1/02

(52) U.S. Cl. ..... 432/83; 432/192; 432/77; 432/254.1; 110/336; 373/74

(58) Field of Search ..... 432/192, 206, 432/173, 233, 77, 83, 84, 85, 248, 251, 254.1, 254.2; 110/336; 373/73, 74

(56) References Cited

U.S. PATENT DOCUMENTS

| | | | | |
|---|---|---|---|---|
| 2,368,265 A | | 1/1945 | Shellenberger | |
| 2,889,698 A | | 6/1959 | Stevens | |
| 3,092,051 A | | 6/1963 | Shapona et al. | |
| 4,021,603 A | * | 5/1977 | Nanjyo et al. | 373/74 |
| 4,157,815 A | | 6/1979 | Saviski et al. | |
| 4,243,384 A | * | 1/1981 | Reinhardt | 432/80 |
| 5,011,402 A | * | 4/1991 | Hammond | 432/238 |
| 5,117,604 A | * | 6/1992 | Bly et al. | 52/509 |
| 5,163,831 A | | 11/1992 | Hammond | |
| 6,418,157 B1 | * | 7/2002 | Fox | 373/74 |

FOREIGN PATENT DOCUMENTS

EP 566 846 A1 10/1993

* cited by examiner

*Primary Examiner*—Gregory Wilson
(74) *Attorney, Agent, or Firm*—Ostrolenk, Faber, Gerb & Soffen, LLP

(57) ABSTRACT

A coolable arched roof for a high-temperature melting furnace having a furnace interior. At least the following layers are present on that side of a layer of refractory bricks, which is remote from the furnace interior: a sealing layer, which is used to seal the furnace interior against the leakage or penetration of gas; an insulation layer having a thermally insulating action; and a cooling layer, which is designed to carry a cooling fluid. The arrangement of layers results in an increased gastightness and prevents premature aging of the refractory bricks.

21 Claims, 2 Drawing Sheets

COOLABLE ARCHED ROOF

BACKGROUND OF THE INVENTION

The invention relates to a coolable arched roof for a high-temperature melting furnace.

Arched roofs for high-temperature melting furnaces, e.g. glass-melting furnaces or electric furnaces, generally comprise a layer, usually a plurality of layers, of heat-resistant (refractory) bricks. These consist, for example, of silicon carbide fireclay, high alumina and/or chromium corundum. Particularly in the case of an unsupported arched roof, the refractory bricks have to be dimensionally stable even under a prolonged thermal load, to ensure that the roof holds. An additional load on the bricks is produced in installations which do not operate permanently, for example reduction melting furnaces in garbage incineration plants, as a result of heat-related contraction and expansion of the bricks. To prevent the service life of the refractory bricks from being shortened, therefore, it is essential to observe the maximum mean temperature taken across the entire layer, which is stipulated by the manufacturer.

The arched roof presents an additional problem in furnaces in which the furnace interior has to be both outwardly and inwardly sealed. By way of example, in reduction melting furnaces, no oxygen must be allowed to penetrate into the furnace from the outside in order not to impair the reducing atmosphere in the furnace interior and in order to prevent metals which have already been reduced from being oxidized again. Furthermore, reducing gas should not penetrate to the outside, since it condenses on cooler, in particular, metallic components and accelerates the corrosion of these components. The seal provided by the refractory layer is further, reduced by wear to the refractory bricks caused by high levels of thermal loads and fluctuations in heat which can lead to deformation of the brickwork.

DE 27 58 755 has disclosed an arched roof which is water-cooled in order to increase the service life of the refractory bricks. The arched roof comprises an arched ring on which a framework of pipes for a coolant is supported. The refractory bricks are laid loosely on to the pipes. The cooling protects the refractory bricks from an excessively high thermal load. However, the arched roof is not sealed. Moreover, the pipes are directly exposed to the furnace atmosphere.

SUMMARY OF THE INVENTION

Therefore, the invention is based on the object of providing an arched roof which is durable and seals the furnace interior against the penetration or leakage of gas.

The coolable arched roof according to the invention comprises, in addition to at least one layer of refractory bricks, on the side thereof which is remote from the furnace interior, at least one sealing layer, an insulation layer with a thermally insulating action and a cooling layer which is designed to carry a cooling fluid.

The sealing layer is used to seal the interior of the furnace against leakage or penetration of gas. It preferably comprises a metal foil. A steel foil, which is preferably reinforced by a glass fiber fabric, is particularly suitable. A sealing layer of this type does not burn or melt at the temperatures of 100 to 450° C. which prevail on that side of the bricks which is remote from the furnace interior and also withstands the excess pressure in the furnace interior. The sealing layer may also be arranged within the refractory layer, for example in the case of a layer structure comprising refractory bricks and light refractory bricks or light refractory plates, may be arranged between the sub-layers formed therefrom, which can then also act as an insulating layer.

To prevent excessive heat losses from the furnace, the sealing layer is separated from the cooling layer by the insulation layer. The insulation layer is used to maintain a predetermined temperature difference between the exterior and interior and between the refractory bricks and the environment. Keeping the sealing layer within a temperature range which does not fall below a predetermined minimum temperature additionally prevents the condensation of aggressive gases on the sealing layer. A predetermined quantity of heat is dissipated via the arched roof by the cooling fluid in the cooling layer.

Therefore, in the arched roof according to the invention, the layers interact in a very advantageous way in order to ensure the durability and seal of the arched roof over the maximum service life of the furnace. In the invention, in particular the mean temperature of the refractory bricks is controlled by targeted dissipation of heat and by building up a temperature gradient from the inside outward.

It is preferable for the thickness and material of the layers and/or the dissipation of heat effected by the cooling fluid to be selected in such a manner that the mean temperature in the refractory bricks does not exceed a predetermined temperature. This temperature is preferably between 1300 and 1600° C., and in particular is approx. 1450° C. The sealing layer is also held within a predetermined temperature range, which is above the dew point of the aggressive gases which are present in the furnace interior. The minimum temperature is preferably 150–250° C., particularly preferably 200° C. The insulation layer can preferably maintain a temperature difference of 100 to 300° C., preferably 200° C. At its surface, it is still preferable for a temperature of 100 to 200° C. to prevail. The cooling layer is preferably in contact with this surface over the entire area of the surface. For this purpose, it is preferable for the cooling layer to comprise a covering layer and pipes which are connected thereto directly or indirectly via contact elements. The cooling layer dissipates a predetermined quantity of heat.

The invention is particularly suitable for furnaces with an unsupported arched roof, since in this case it is particularly important to maintain a predetermined mean temperature in the refractory bricks, for stability reasons. Furthermore, the invention is suitable for furnaces in which the gas atmosphere in the furnace interior has to be particularly well controlled, for example for reduction melting furnaces, in particular for those used to treat slag from garbage incineration.

BRIEF DESCRIPTION OF THE DRAWINGS

Examples of the invention are illustrated in the drawings and described below. In the drawings.

DETAILED DESCRIPTION OF THE PREFERRED EMBODIMENTS

Figure 1:
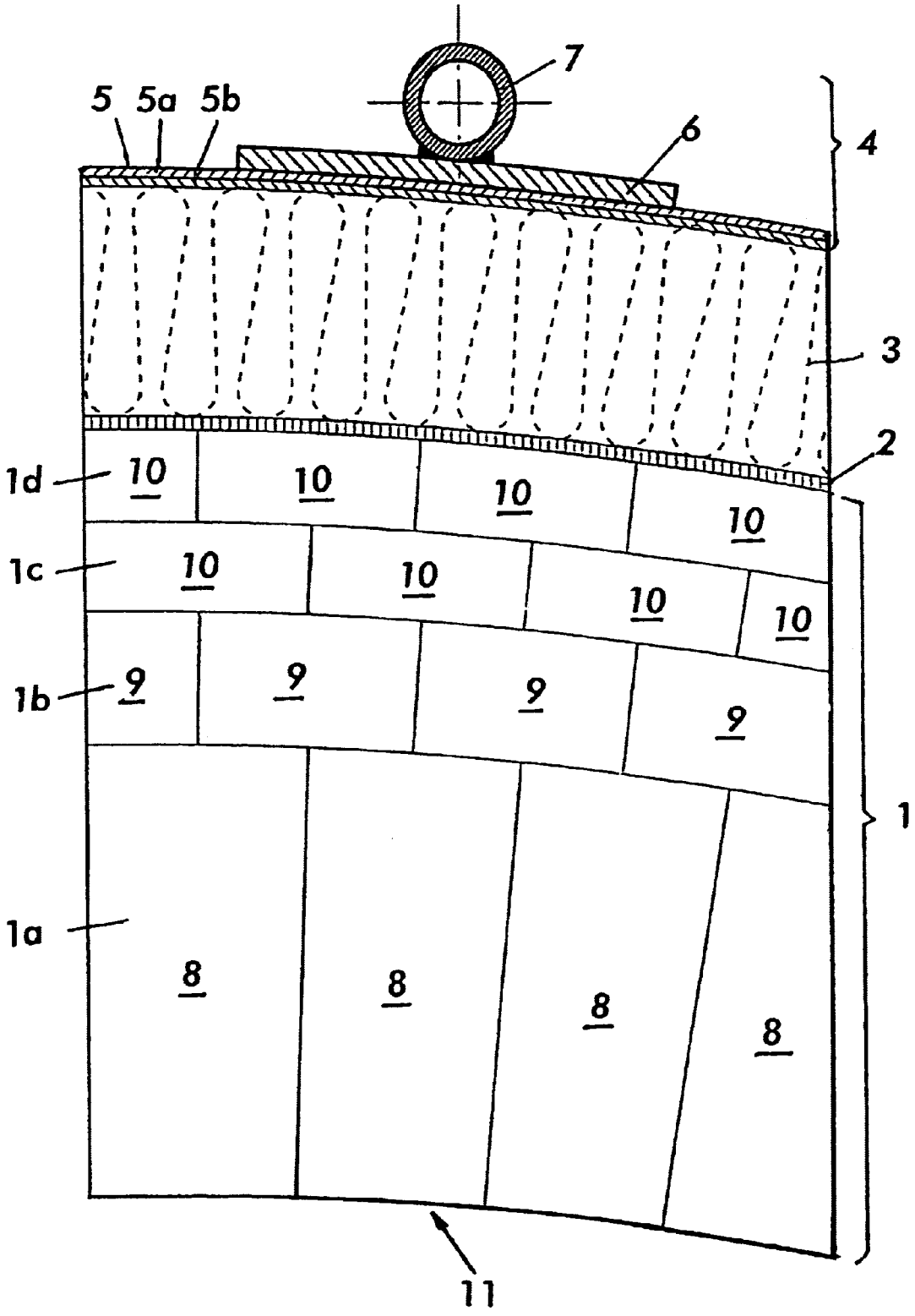
FIG. 1 diagrammatically depicts the layer structure of an arched roof according to the invention.

FIG. 1 shows the layer structure of an arched roof according to the invention. The supporting arch is formed by a layer 1 of refractory bricks, which comprises four sub-layers 1*a–d*. Above a first sub-layer 1*a* of refractory bricks 8 there is a second sub-layer 1*b* of light refractory bricks 9. This is adjoined by two further sub-layers 1*c*, 1*d* of light refractory plates 10, which have a particularly good heat-insulating action. The sealing 2 which seals the furnace interior 11 in a gastight manner is arranged on the top sub-layer 1*d*. On the sealing layer 2 is the insulation layer 3, which has a thermally insulating action and ensures that the sealing layer 2 does not cool below a defined minimum temperature. The insulation layer 3 is adjoined by the cooling layer 4, which comprises a covering layer 5 which in this case is formed from two layers of foil 5*a*, 5*b*. The covering layer 5 is thermally conductive. Pipes 7 for the cooling fluid are connected to contact elements 6 which are in plate form and ensure heat transfer between the covering layer 5 and the pipes 7 or the cooling fluid. The shape of the contact elements 6 is matched to the shape of the arched roof, so that large-area contact is produced.

The pipes 7 which, like the contact elements 6, consist of a metal with a high thermal conductivity, are preferably welded to the contact elements 6. The contact element 6 and the pipe 7 may also be formed integrally. The cooling fluid used is preferably water. It is also possible to use air, but this has the drawback of a lower heat capacity.

The first sub-layer 1*a* has a thickness, for example, of 200 to 400 mm, preferably about 300 mm. The refractory bricks 8 consist, for example, of approx. 60% of $Al_2O_3$, 3% of $SiO_2$, 0.3% of $Fe_2O_3$ and 30% symbol of $Cr_2O_3$. The thermal conductivity is preferably between 1 and 5 W/mK and is, for example, approx. 3 W/mK (at 700° C.) or 2.8 W/mK (at 1000° C.). By way of example, at temperatures in the furnace interior 11 the first sub-layer has a mean temperature of 1400 to 1500° C.

The second sub-layer 1*b* has a thickness, for example, of 40 to 90 mm, preferably 65 mm. The refractory bricks 9 consist, for example, of approx. 68% of $Al_2O_3$, 30% of $SiO_2$, 0.4% of $Fe_2O_3$ and 0.4% symbol of CaO. The thermal conductivity is preferably between 0.2 and 1.0 W/mK. It is, for example, about 0.32 W/mK (at 400° C.) and 0.41 W/mK (at 1200° C.). Therefore, the second sub-layer 1*b* already has a reduced thermal conductivity. Its mean temperature is approximately 950 to 1050° C.

The third and fourth sub-layers 1*c*, 1*d* each have a thickness of; for example, 20 to 60 mm, preferably 40 mm. The light refractory plates 10 consist, for example, of approx. 43% of $Al_2O_3$, 51% of $SiO_2$, 1.3% of $Fe_2O_3$ and 0.3% symbol of CaO. The thermal conductivity is between approximately 0.29 W/mK (at 400° C.) and 0.37 W/mK (at 1000° C.), i.e. this sub-layer has a further reduced thermal conductivity. In general, the thermal conductivity is preferably between 0.2 and 1.0 W/mK. The mean temperature of this third sub-layer is approximately 600 to 700° C., and the mean temperature of the fourth sub-layer is approximately 250 to 450° C.

The sealing layer 2 comprises a steel foil with a thickness of between 50and 300 $\mu$m, preferably 250 $\mu$m. The steel foil is reinforced by a 0.5 to 1 mm thick glass fiber fabric.

When the temperature in the furnace interior is from 1500 to 1700° C., the temperature at the top sub-layer id or at the sealing layer 2 is preferably 100 to 300° C.

The insulation layer 3, which has a thickness of 50 to 200 mm, preferably approximately 100 mm, comprises an insulating material which is able to maintain a heat difference of approx. 200° C. between the sealing layer 2 and the cooling layer 4. The thermal conductivity of the insulation layer is preferably between 0.05 and 0.2 W/mK. The material is, for example, insulating fabric or felt based on rock wool.

By way of example, the covering layer 5 used is two layers of an aluminum foil which are in each case 50 to 300 $\mu$m, preferably 50 $\mu$m, thick and may likewise be glass-fiber reinforced. The temperature of the covering layer 5 is between 20 and 200° C.

The pipes 7 are to be arranged and dimensioned in such a way, and the cooling fluid and its flow velocity are to be selected in such a way, that a heat flux of approximately 3000 $W/m^2$ is dissipated.

Figure 2:
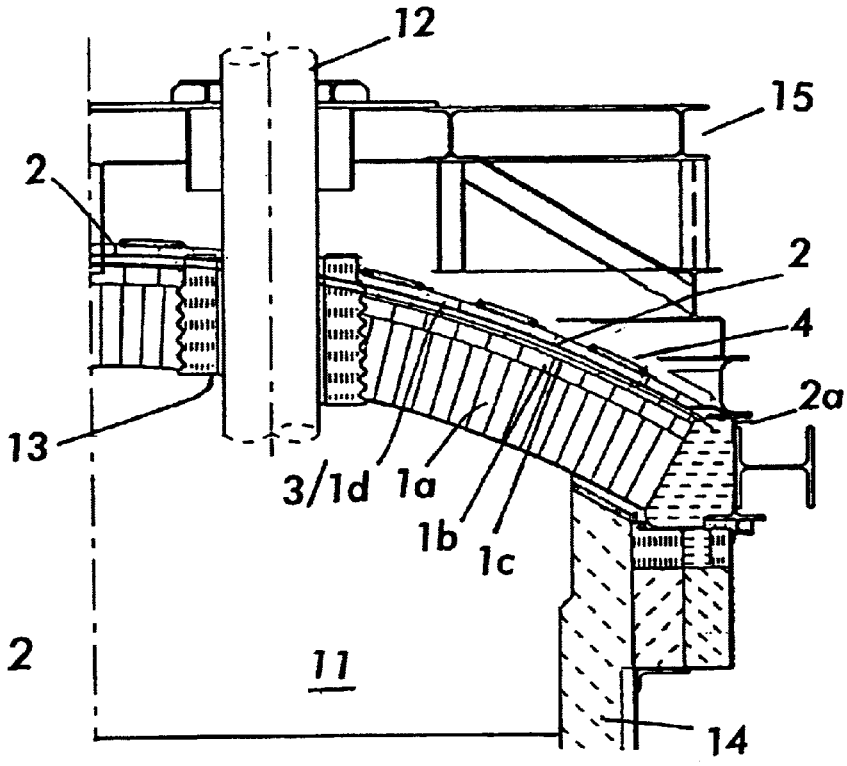
FIG. 2 diagrammatically depicts a section through an arched roof.

FIG. 2 shows a section through an arched roof according to the invention for a reduction melting furnace. Unlike in FIG. 1, there is no separate insulation layer next to the layer 1 of refractory bricks. Rather, the insulation layer 3 is produced by the top sub-layer 1*d* of light refractory plates 10. As described above, the latter already have a thermally insulating function. Accordingly, the sealing layer 2 is arranged between the third sub-layer 1*c* and the top sub-layer 1*d*. The cooling layer 4 is located directly on the insulation layer 3 (top sub-layer 1*d*). The arched roof is self-supporting and at the sides is supported on the side walls 14 of the arch. An external structure 15 is used to hold a melting electrode 12. The electrode 12 is guided from above through an opening 13 in the arched roof into the furnace interior 11 and is in contact with the melt, which is not shown in this figure. The opening 13 is closed off in a gastight manner which is not illustrated in the present figure. By way of example, a water lute, which simultaneously serves as a pressure relief valve, is suitable.

To increase the gastightness of the arched roof, the sealing layer 2 or the foil used for this layer projects with respect to the refractory layer 1 and the insulation layer 3 and is externally anchored to the arch by means of the projecting edge region 2*a*.

Figure 3:
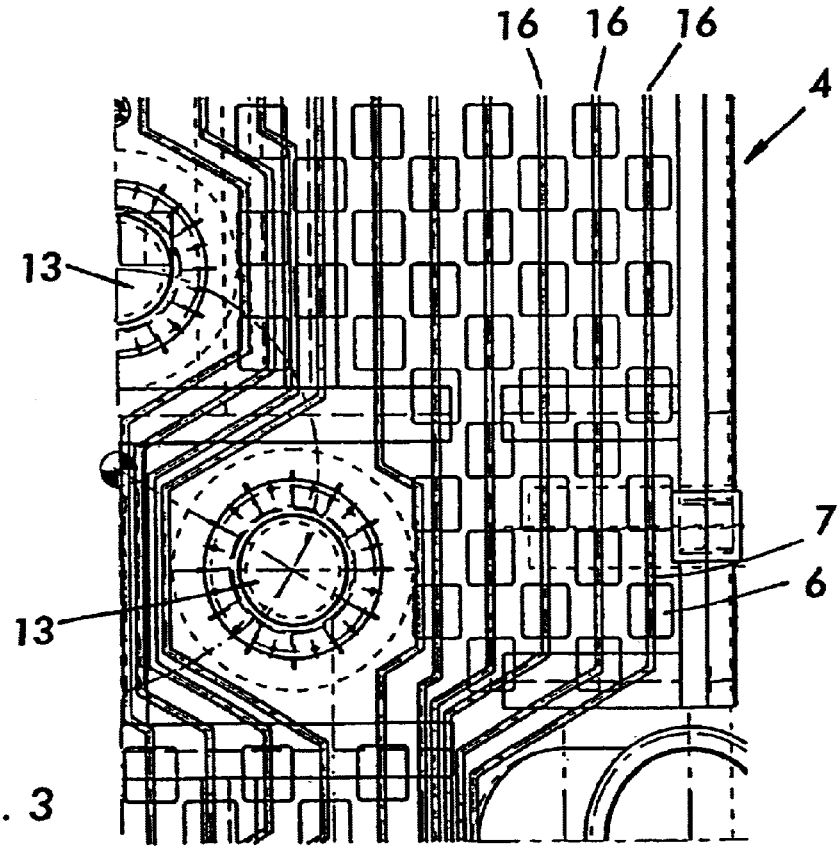
FIG. 3 shows a plan view of a cooling layer.

FIG. 3 shows a plan view of the arched roof or the cooling lay e r 4. The cooling layer 4 comprises pipes 7 which are in the form of a multiplicity of separate pipe loops 16. Each pipe loop 16 is connected both to a coolant feed line and to a coolant discharge line. This results in effective dissipation of heat, the heating of the coolant within each pipe loop 16 being kept at a low level. The pipes are connected to contact elements 6 in the form of plates which rest on the insulation layer 3. The openings 13 for the electrodes 12 are cut out. A further insulation layer (not shown here) may be arranged on the cooling layer 4.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. A coolable arched roof for a high-temperature melting furnace having a furnace interior, the arched roof comprising:

at least one layer of refractory bricks having a side remote from the furnace interior; and an arrangement of layers on the side of the at least one layer of refractory bricks which is remote from the furnace interior, the arrangement of layers including: a sealing layer arranged so as to seal the furnace interior against an escape or penetration of gas; an insulation layer with a thermally insulating action; and a cooling layer designed to carry a cooling fluid.

2. The arched roof as defined in claim 1, wherein one of dissipation of heat effected by the cooling fluid and a thickness and material of the layers are such so that mean temperature in the refractory bricks does not exceed a predetermined temperature.

3. The arched roof as defined in claim 2, wherein the predetermined temperature of the refractory bricks is between 1300 and 1600° C.

4. The arched roof as defined in claim 3, wherein the predetermined temperature of the refractory bricks is about 1450° C.

5. The arched roof as defined in claim 2, wherein the thickness and material of the layers and/or the dissipation of heat effected by the cooling fluid are such that a temperature of the sealing layer does not fall below a predetermined minimum temperature.

6. The arched roof as defined in claim 5, wherein the minimum temperature o f the sealing layer is between 100 and 300° C.

7. The arched roof as defined in claim 6, wherein the minimum temperature of the sealing layer is 200° C.

8. The arched roof as defined in claim 1, wherein the sealing layer comprises a metal foil.

9. The arched roof as defined in claim 8, wherein the metal foil is a steel foil with a thickness of 50 to 300 mm.

10. The arched roof as defined in claim 9, wherein the steel foil h as a thickness of 250 mm.

11. The arched roof as defined in claim 8, wherein the sealing layer comprises a glass fiber fabric which is joined to the metal foil.

12. The arched roof as defined in claim 1, wherein the insulating layer has a thickness in a range from 50 to 200 mm, and a thermal conductivity in the range from 0.05 to 0.2.

13. The arched roof as defined in claim 8, wherein the insulating layer consists of one of insulating fabric and felt based on rock wool.

14. The arched roof as defined in claim 1, wherein the cooling layer comprises at least one covering layer which rests on the insulating layer and is made from a thermally conductive material, and pipes for the cooling fluid which are connected to the covering layer via heat bridges.

15. The arched roof as defined in claim 14, wherein the pipes are connected to thermally conductive contact elements which run parallel to the covering layer and are in large area contact therewith.

16. The arched roof as defined in claim 14, wherein the covering layer comprises a metal foil.

17. The arched roof as defined in claim 16, wherein the metal foil is reinforced by a glass fiber fabric.

18. The arched roof as defined in claim 1, wherein the cooling fluid is water.

19. The arched roof as defined in claim 1, wherein dissipation of heat effected by the cooling fluid is between 1000 and 5000 $W/m^2$.

20. The arched roof as defined in claim 19, wherein the dissipation of heat affected by the cooling fluid is 3000 $W/m^2$.

21. A melting furnace, comprising an arched roof having at least one layer of refractory bricks having a side remote from the furnace interior, and an arrangement of layers on the side of the at least one layer of refractory bricks which is remote from the furnace interior, the arrangement of layers including a sealing layer arranged so as to seal the furnace interior against an escape or penetration of gas, an insulation layer with a thermally insulating action, and a cooling layer designed to carry a cooling fluid.

* * * * *